United States Patent [19]

Giorgetti et al.

[11] 3,985,370

[45] Oct. 12, 1976

[54] COMBINATION SKI BOOT, CLAMP AND SKI HOLDER

[76] Inventors: Giorgio Giorgetti, Valdinievole 67, Bientina (Pisa); Giancarlo Ciacci, Via Brennero 270, Abetone (Pistoia), both of Italy

[22] Filed: July 3, 1975

[21] Appl. No.: 592,891

[30] Foreign Application Priority Data

July 5, 1974 Italy ..... 9506/74

[52] U.S. Cl. ..... 280/605; 280/626

[51] Int. Cl.[2] ..... A63C 7/10; A63C 9/08

[58] Field of Search ..... 280/11.13 B, 11.13 C, 280/11.13 D, 11.13 Z, 11.35 R, 604, 605, 611, 626, 623

[56] References Cited

UNITED STATES PATENTS

| | | | |
|---|---|---|---|
| 2,643,888 | 6/1953 | Hargis, Jr. | 280/11.35 D |
| 3,433,494 | 3/1969 | Hinterholzer | 280/11.13 B |
| 3,781,026 | 12/1973 | Bovee | 280/11.13 B |
| 3,909,024 | 9/1975 | Salomon | 280/11.13 B |

FOREIGN PATENTS OR APPLICATIONS

| | | | |
|---|---|---|---|
| 432,539 | 8/1926 | Germany | 280/11.13 B |
| 1,179,844 | 10/1964 | Germany | 180/11.13 B |
| 5,721 | 10/1897 | Norway | 280/11.13 C |

*Primary Examiner*—M. H. Wood, Jr.
*Assistant Examiner*—Milton L. Smith
*Attorney, Agent, or Firm*—McGlew and Tuttle

[57] ABSTRACT

A ski boot clamping device comprises a ski clamp mounting plate which has an end with a raised portion forming a hook. The boot clamp has a first portion which is adapted to extend across the ski for engagement with the rear end of the boot and which has a skirt which has an engagement end which is engageable behind the plate raised portion with the hook. The boot clamp also has a second portion which is rotatably mounted in a cylindrical formation on the side of the ski and it is biased by a spring so that when the first portion becomes released from the boot, the first portion is rotated by rotation of the second portion at least over 180° so that it extends downwardly into engagement with the snow so as to hold the ski against movement.

6 Claims, 5 Drawing Figures

COMBINATION SKI BOOT, CLAMP AND SKI HOLDER

FIELD AND BACKGROUND OF THE INVENTION

This invention relates in general to the construction of skis and, in particular, to a new and useful ski boot clamping device which includes means to hold the ski against movement when the clamping device is released from the boot.

DESCRIPTION OF THE PRIOR ART

At the present time, substantially all of the known safety bindings for skis are equipped with an automatic device which permits the detachment of the ski whenever the skier's foot is in a particularly dangerous position as in a fall or similar situation in which the retention of the ski would be liable to severely injure the skier. It is also quite important that the ski which is released from the skier's foot should stop by itself in order to permit an easy recovery of the ski by the person who has lost it and to avoid damage to third persons by its movement along the ground. Several devices are known for this purpose, and some of them are operable with the tip of the boot and others with the heel, but each of them has a disadvantage in respect to the difficulty of their installation and operation and in respect to their acceptance by professional or experienced skiers.

Among the greatest drawbacks of the known devices is that they offer resistance to gliding or there is a possibility that they may strike against the snowy surface during the course of skiing. A further disadvantage is that the known devices require special means for attachment to the ski and the known structures are not employed for this purpose.

A disadvantage of the devices which are operable with the tip of the boot, rather than the heel, is that of presenting in the zone below the tip of the boot a surface which offers considerable friction against the front part of the sole and this is in disagreement with the concept used by the ski binding manufacturers, wherein, it is believed that such friction should be reduced to a minimum in order to ensure the greatest possibility of rotation of the boot and to give the highest safety in a twisting fall. In devices which are controllable with the heel of the boot, one solution includes a single body formation with a safety binding and this involves an excessive increase of the longitudinal dimension of the structure and this is detrimental to the flexibility of the ski. In general, the devices which are known employ exposed parts which are therefore readily subject to the action of foreign bodies, as well as to that of corrosion.

SUMMARY OF THE INVENTION

The present invention provides a device for automatically stopping a ski if it becomes dislodged from the foot of the skier and which is advantageously operable with the heel or the rear part of the sole of the boot and will become effective both in the intentional releases of the ski, as in the case of an involuntary fall and of a construction which presents considerable advantages over the known devices.

The present invention provides a construction wherein a ski clamp mounting plate has an end with a raised portion forming a hook and a boot clamp member includes a first portion which is adapted to extend across the ski for engagement with one end of the boot and has a skirt portion which engages with the hook in a skiing position. The boot clamp includes a second arm portion which is adapted to extend alongside the ski in a cylinder which permits its rotation and it is biased by a spring to rotate whenever the first portion is released from the boot beyond 180° so as to engage downwardly into the snow and hold the ski against movement. The construction is such that it does not obstruct the flanks of the ski and it does not offer opposing resistance to the rotation of the boot. The construction also permits adapting the arrangement to any kind of safety binding and to employ the usual fastening holes for the ski plate and binding without changing either the form or the function thereof. The device may be made with mechanical parts which will remain completely protected and always in an enclosure permitting their lubrication for fast action.

Accordingly, it is an object of the invention to provide an improved ski binding, particularly for use with the rear of a ski boot, and which includes a ski boot engagement member which, upon release from the boot, may be rotated to a position in which it engages into the snow and prevents movement of the ski.

A further object of the invention is to provide a ski clamping and holding device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

DESCRIPTION OF THE PREFERRED EMBODIMENTS

Figures 1, 2, 3, 4, 5:
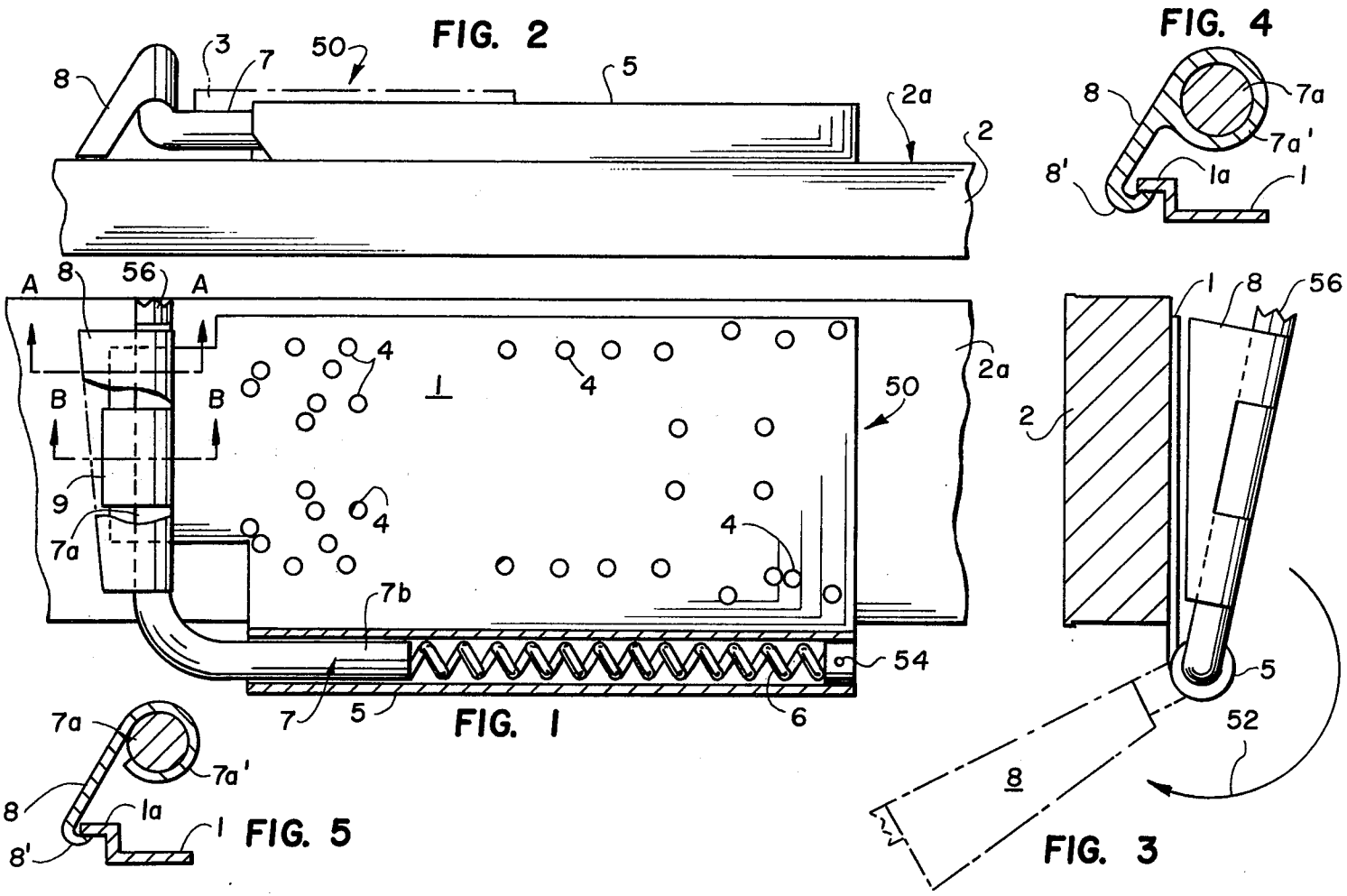
FIG. 1 is a partial horizontal sectional and top plan view of the ski having a clamping and holding device constructed in accordance with the invention.
FIG. 2 is a partial side elevational view of the device shown in FIG. 1.
FIG. 3 is a rear elevational view of the ski with the clamping and holding device shown in FIG. 1.
FIG. 4 is a section taken along the line A—A of FIG. 1.
FIG. 5 is a section taken along the line B—B of FIG. 1.

Referring to the drawings in particular, the invention embodied therein, comprises a combined ski boot clamping and ski holding device, generally designated 50, which is preferably used with the rear of a ski boot. The device includes the usual ski clamp mounting plate 1 having a plurality of openings for the passage of securing screws 4 to hold the plate to a ski 2.

In accordance with the invention, the combined ski boot clamping device and ski holder comprises a boot clamp member, generally designated 7, which includes a first portion or first arm **7*a* which extends transversely of the ski 2 and provides a rounded rear part 7*a*′ which engages into a suitable recess of the ski boot. In the clamping position, a rear skirt part 8 has a lower hook-shape engagement end 8′ which engages beneath a hook formation 1***a* on a raised rear portion of mounting plate 1. The boot clamp member 7 also includes a second arm portion 7*b* which is rotatable in a cylinder or tube 5 which extends along one side of the mounting plate 1 and one side of the ski 2. Arm portion 7*b* is urged to rotate by a torsion spring 6 secured thereto in the direction of an arrow 52, as shown in FIG. 3, beyond 180° of movement so that it extends, for example, obliquely and downwardly into the snow and prevents the further movement of the ski after it has become released from the boot for whatever reason. The spring 6 is advantageously anchored at its one end in a collar 54 which is carried at the front end of the tube 5. The outer end of the arm portion 7*a* is provided with a knurled edge or star-shape portion 56 to facilitate its engagement into the snow or ice.

The clamping arm 7*a* will become released by disengagement of the hook-shape part 8′ from hook part 1*a* which will occur when there is a pressure sufficient to overcome the holding force of the torsion spring 6, for example. For this purpose, the skirt 8 is advantageously made of a triangular form and it extends substantially over the entire length of the arm portion 7*a*. In the clamping position, the arm 7*a* will be inclined and not parallel to the upper face of the ski in order to permit a slight lowering thereof which would effect the unhooking of the skirt from the holding hook 1*a* whenever the arm 7*a* is squeezed by the rear end of the heel or sole of the boot.

The arm 7*a* is also prevented from being rotated beyond an angle at which it extends obliquely downwardly to one side so that it provides a sufficient extension surface to prevent further movement of the ski. The skirt portion is such that it provides sufficient frictional engagement with the hook 1*a* to prevent the rehooking of the part 8′ through the hook 1*a* once it has been squeezed rearwardly by the boot and then released from the boot.

The spring 6 applies a forwardly directed bias or holding force on the clamping arm 6*a* and when the boot is inserted in place it pushes the arm 7*a* rearwardly against the holding force of the coiled torsion spring 6, but not sufficiently to disengage the part 8′ from the hook 1*a*.

An envelopment spring 9 of the irreversible type may be provided in addition to the spring 6 and, in this arrangement, the heel or rear part of the sole of the boot presses on the movable arm 7*a* every time the skier puts on the ski. The arm skirt portion 8′ releases from the hook 1*a*, and puts the arm under action of the spring 9 which also facilitates its rotation of more than 180° so that it plants the end 56 into the snow and causes the automatic stopping of the ski.

While specific embodiments of the invention have been shown and described in detail to illustrate the application of the principles of the invention, it will be understood that the invention may be embodied otherwise without departing from such principles.

What is claimed is:

1. A ski boot clamping device, comprising a ski clamp mounting plate having an end with a portion forming a hook, a boot clamp having a first arm portion adapted to extend across the ski for engagement with one end of the boot and having a skirt portion with an engagement end engageable behind said plate raised portion with said hook, said boot clamp having a second arm portion adapted to extend along said ski, means associated with said plate for rotatably supporting said second arm portion so as to permit rotation thereof and pivoting of said first arm portion between a first boot clamping position extending transversely of said ski and a second position in which it is released from the boot and rotated beyond 180° from the first position to extend downwardly into engagement with the snow so as to hold the ski against movement, and a torsion spring connected to said second arm portion and biasing it forwardly against the ski-boot but permitting rearward movement of said second arm portion with said first arm portion to release said engagement end from said hook and to cause said spring to rotate said first arm portion with said second arm portion to said second position.

2. A ski boot clamping device, according to claim 1, wherein said boot clamp comprises a member positioned at the rear of the boot and forming a rear boot clamp and having a rounded surface engageable with the rear of said ski boot.

3. A ski boot clamping device, according to claim 1, wherein said first arm portion has an outer end with a knurled formation.

4. A ski boot clamping device, according to claim 1, wherein said means associated with said plate for rotatably supporting said second arm portion comprises a cylinder formed at one side of said plate extending longitudinally of the ski.

5. A ski boot clamping device, according to claim 1, wherein said plate comprises a heel plate, said means rotatably supporting said second arm portion comprising a cylinder formed on said heel plate and said torsion spring being in said cylinder and biasing said second arm portion to rotate with said first arm portion to a position engaged obliquely downwardly into the snow after release from the boot.

6. A ski boot clamping device, according to claim 1, wherein said mounting plate comprises a flat rectangular plate forming a heel plate adapted to be placed under the heel and having a plurality of openings therethrough for fastening devices to secure the plate to the ski.

* * * * *